United States Patent [19]

Machau

[11] Patent Number: 4,924,545

[45] Date of Patent: May 15, 1990

[54] PROCESS AND APPARATUS FOR MERCERIZING A FABRIC WEB

[75] Inventor: Susanne Machau, Jonschwil, Switzerland

[73] Assignee: Benninger AG, Uzwil, Switzerland

[21] Appl. No.: 237,306

[22] Filed: Aug. 25, 1988

[30] Foreign Application Priority Data

Aug. 26, 1987 [CH] Switzerland ..... 3273/87

[51] Int. Cl.[5] ..... D06B 7/08

[52] U.S. Cl. ..... 8/151; 26/52; 68/205 R; 68/13 R

[58] Field of Search ..... 26/1, 52; 8/151; 68/205 R, 13 R

[56] References Cited

U.S. PATENT DOCUMENTS 1,159,729 11/1915 Stevens ..... 68/205 R
2,239,636 4/1941 Weiss ..... 68/13 R
2,613,521 10/1952 Walmsley ..... 8/151 X
2,613,522 10/1952 Heffelfinger ..... 8/151 X
2,769,685 11/1956 Cowles et al. ..... 26/52
4,731,893 3/1988 Tanaka ..... 68/13 R

*Primary Examiner*—Frankie L. Stinson
*Attorney, Agent, or Firm*—William R. Hinds

[57] ABSTRACT

In order to be able to distribute the stretching forces more uniformly when stretching the fabric web in respect of width in the conical entry area of the tentering frame, the edge zones (14, 14') of the fabric web (2) are sprayed with a hot medium, for example hot weak lye, more heavily than the central zone (19). The already stabilized edge zones thus transmit the stretching forces into the central zone, thus avoiding different spacings between the warp threads after the stretching operation. Differentiated spraying is achieved by means of spray pipes (13) which are arranged in a particular fashion.

11 Claims, 4 Drawing Sheets

PROCESS AND APPARATUS FOR MERCERIZING A FABRIC WEB

Figure 1A:
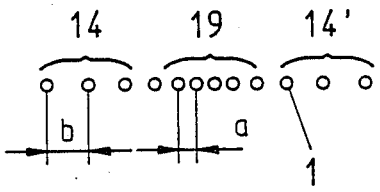

This invention relates to a process and an apparatus for mercerising a fabric web. The process is of the type in which the fabric web is stretched in respect of width after an impregnation operation by means of a pair of tentering chains in a tentering frame with a generally conical inlet area, wherein the fabric web is sprayed with a hot medium from spray nozzles arranged above the tentering frame, for stabilisation purposes. The apparatus is of the type comprising a tentering frame having a pair of tentering chains and a conical entry area for stretching the fabric web in respect of width after an impregnation operation, and spray nozzles arranged above the tentering frame for spraying the fabric web with a hot medium.

Generally, the fabric web is sprayed by means of hot weak lye or by means of hot steam, in the zone in which it is stretched in respect of width. That procedure reduces shrinkage forces and provides for stabilisation of the fabric web. The operation of stretching the fabric web in respect of width itself again partially compensates for shrinkage of the fabric which is triggered off by the impregnation process. A process which is comparable in its general nature is disclosed for example in the present applicants' EP-A-No. 0 198 793.

A known problem involved in stretching fabric webs in respect of width is that the stretching forces act differently on the fabric web, which, after the operation of stretching the web in respect of width, results in an irregular arrangement of the warp threads. When stretching a fabric web ins respect of width by means of a tentering chain, there is a tendency that only the outer edge portions are stretched so that the stretching effect decreases towards the middle of the fabric web. That effect is precisely reversed when effecting a width stretching operation without using a chain, by means of width stretching rollers. In that case, as a result of differences in static friction, only the central part is stretched while the edge zones easily shrink. To avoid those disadvantages DE-A-No. 1 106 282 has already proposed that a chain-less mercerising portion should be combined with an adjoining chain-type mercerising portion, to provide a novel mercerising machine. However that combination of two different widthwise stretching apparatuses requires a considerable level of apparatus expenditure, while the fabric web is exposed to considerable mechanical loadings which can have a disadvantageous effect when dealing with fabrics of sensitive qualities.

Therefore an object of the present invention is to provide a process of the kind set forth in the opening part of this specification, in which stretching of the fabric web is effected over the entire width thereof uniformly and in a careful fashion without expensive structural arrangements. In particular the invention seeks to provide that the warp thread spacing is uniform over the entire width of the fabric web so that the web is of the same density throughout.

That object is achieved by providing a process for mercerising a fabric web in which the fabric web is stretched in respect of width after an impregnation operation by means of a pair of tentering chains in a tentering frame with a generally conical entry area, wherein the fabric web is sprayed with a hot medium from spray nozzles arranged above the tentering frame, for stabilization purposes, improved in that at least in the conical entry area of the tentering frame the edge zones of the fabric web are sprayed more heavily than the central zone thereof. That arrangement provides firstly that only the edge zone and not the central zone of the fabric web is stabilised. The result of that is that the width-wise stretching forces which are produced by the tentering chains are transmitted by the edge zones which are already stabilised, into the central zone which has not yet been stabilised or which has been only slightly stabilised. That provides for a substantially uniform stretching force over the entire width of the textile web so that the warp threads are also drawn apart in the central zone. The stretching forces are not already expended in the edge zone due to yielding thereof, as that is prevented by virtue of the controlled stabilisation effect. The spray density advantageously decreases substantially uniformly from the edge zones towards the central zone of the fabric web as the stretching forces are also reduced towards the centre of the fabric web. The edge zone is in each case at least 10% of the width of the article and at most 40% of that width. In that connection at least double the amount of hot medium is sprayed onto the edge zone.

In regard to apparatus, the object of the invention is achieved by providing apparatus for mercerising a fabric web comprising a tentering frame having a pair of tentering chains and a conical entry area for stretching the fabric web in respect of width after an impregnation operation, and spray nozzles arranged above the tentering frame for spraying the fabric web with a hot medium, improved in that at least in the conical entry area of the tentering frame the spray nozzles are arranged predominantly over the two edge zones of the fabric web so as to spray the edge zones more heavily than the central zone of the fabric, the edge zones respectively making up at least ten percent and at most forty percent of the set fabric web width. The spray nozzles may be arranged on a pair of spray pipes, arranged at the desired angle and at the desired spacing relative to the outside edges of the fabric web over the conical entry area of the tentering frame. Preferably the pairs of spray pipes are arranged at the same angle as the conical entry area so that the edge zones are uniformly sprayed in the course of the forward feed movement of the fabric web. The spray pipes however may also be at a slightly differing angle relative to the outside edge of the fabric web in the conical entry area of the tentering frame. It would also be possible for the spray pipes to be arranged movably in regard to their angular position so that in the course of the forward feed movement of the fabric web, the spray pipes spray an edge zone which taperingly increases or decreases in width. Finally it would also be possible to use spray pipes which are curved inwardly or outwardly in the plane of the fabric web. More intensive spraying of the edge zones could extend beyond the conical entry area of the tentering frame into the portion with parallel sides.

A particularly simple construction provides that the spray nozzles are such, in regard to arrangement and/or opening cross-section, that the amount of sprayed medium decreases towards the central zone of the fabric web. In that way a single spray pipe is sufficient, over both edge zones, to achieve the desired effect.

In order to be able to treat webs of different widths, the tentering frame advantageously has an adjusting device for varying the distance between the two tentering chains, wherein the spray pipes are arranged on the tentering frame in such a way that they are adjustable together with the tentering chains. In that way the spray pipes are always at approximately the same distance relative to the outside edge of the fabric web, over the two edge zones. In certain cases however the adjusting device may also be such that, upon adjustment of the tentering chains, the spray pipes cover a proportionally shorter distance.

In certain cases it may also be advantageous if a plurality of parallel spray pipes are arranged over each edge zone, which spray pipes can be actuated individually by way of control valves. Those spray pipes may be arranged fixedly so that, when dealing with a fabric web of a different width, only the tentering chains have to be adjusted. The spray density can be preselected by suitable setting of the spray valves. In that respect individual spray pipes can be entirely switched off or only partly supplied with the hot medium.

The edge zones preferably constitute about 30% of the set width of the fabric web but at least 10% and not more than 40%.

For complete conclusion of the mercerising process, the arrangement may have spray pipes which extend transversely to the fabric web over the parallel-sided area of the tentering frame and which are provided with spray nozzles uniformly distributed over the entire width of the fabric web. The parallel-sided area of the tentering frame directly adjoins the conical entry area with the spray pipes over the edge zones. The spray pipes which are arranged transversely with respect to the fabric web spray the stretched fabric web uniformly over the entire width thereof and thus provide for a final stabilisation effect.

Figure 1B:
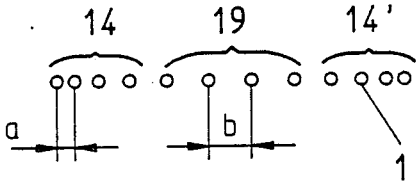
Figure 1C:
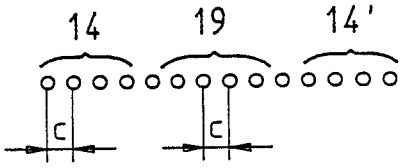
Figure 4:
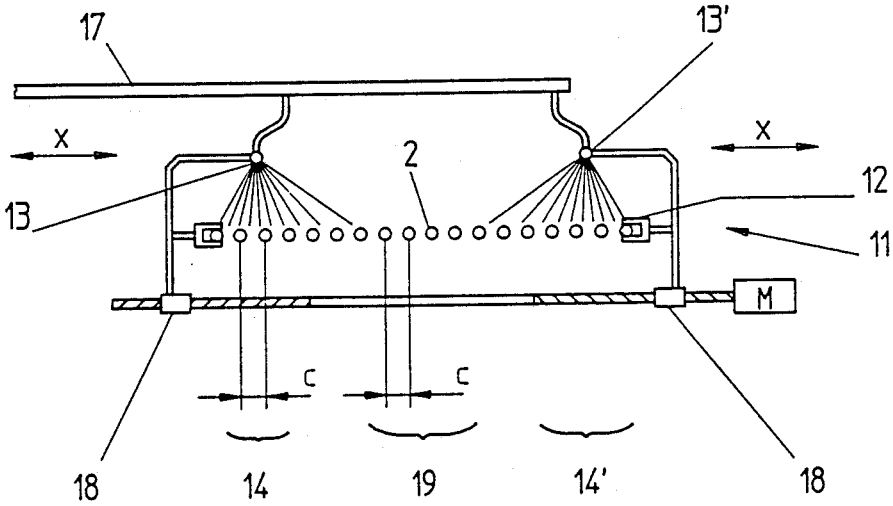
Figures 2, 3:
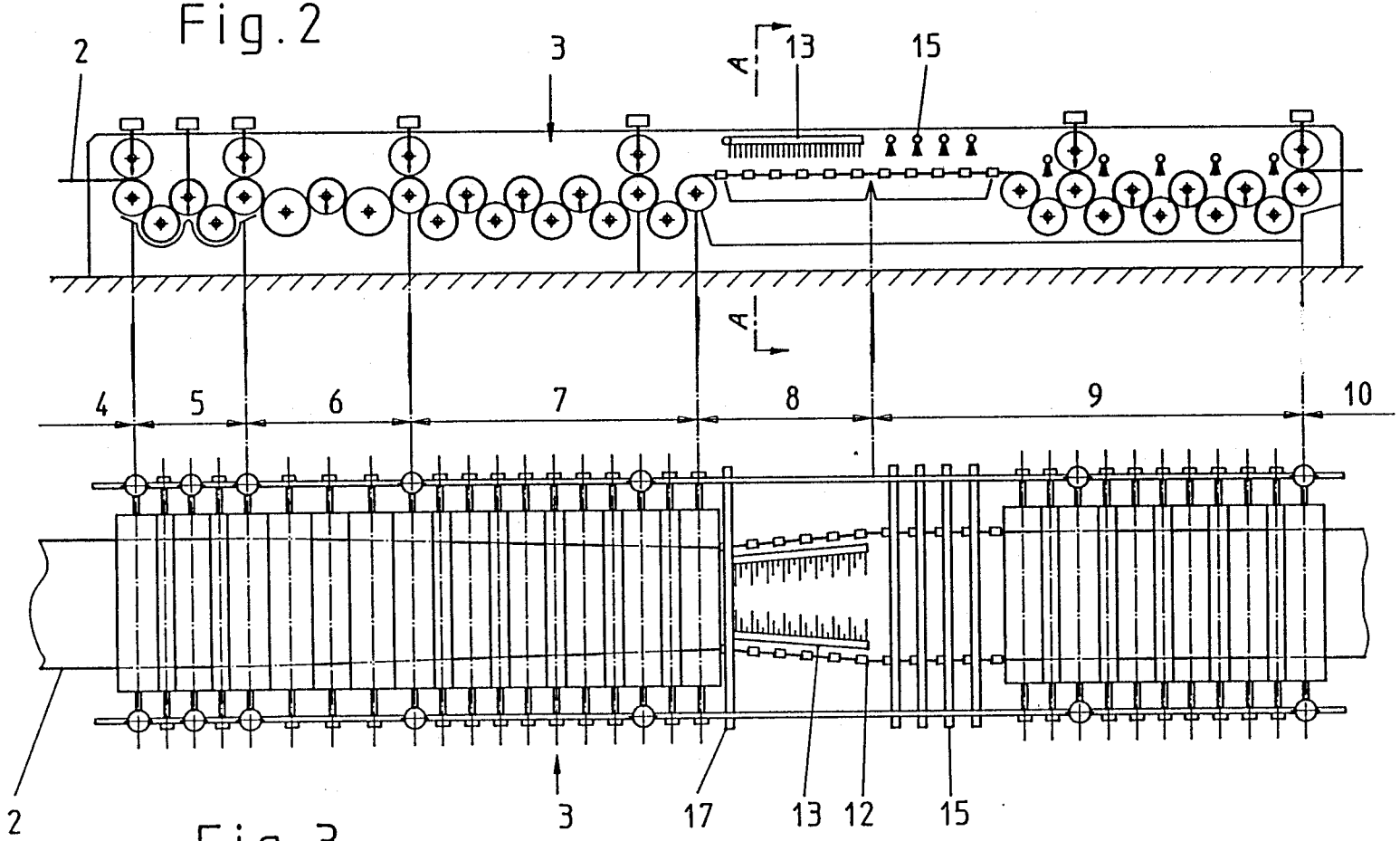
Figure 5:
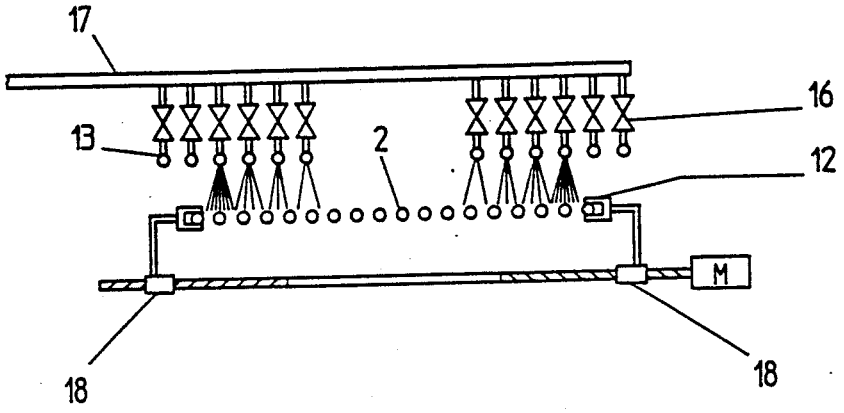
Figure 6:
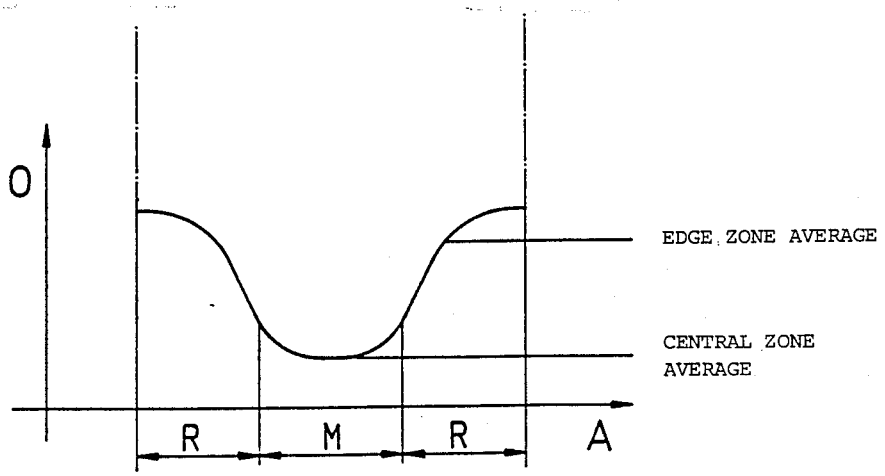
Figure 7:
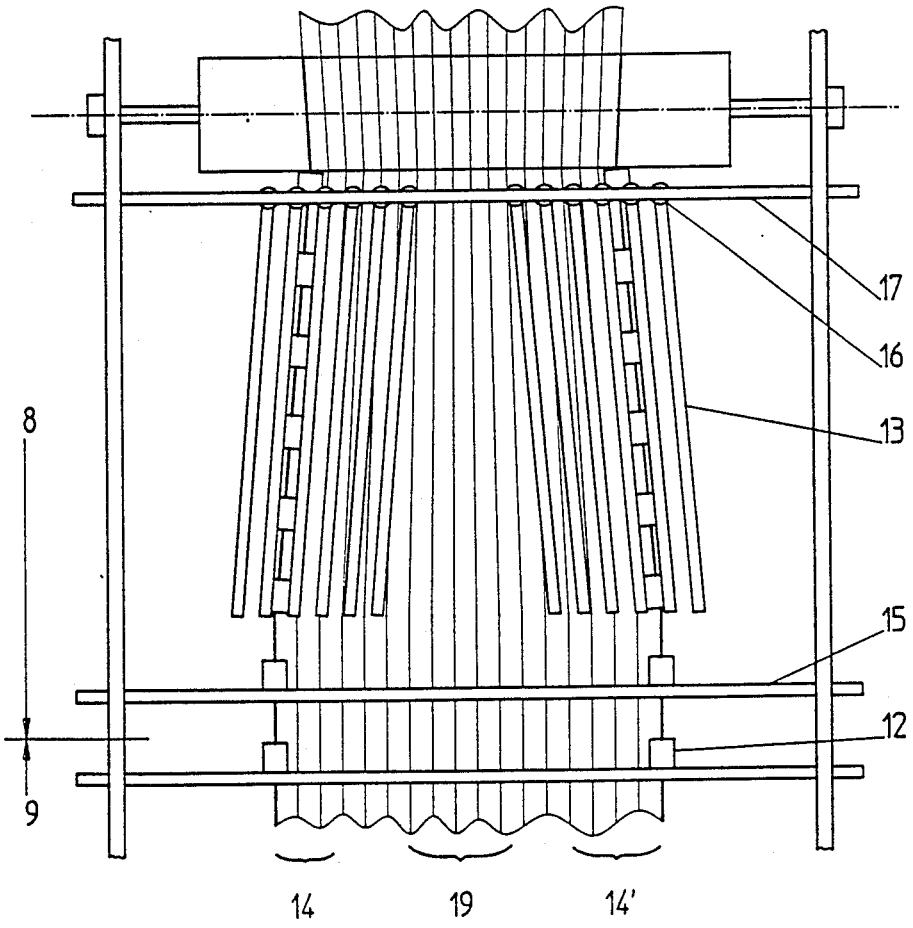

Embodiments of the invention are described in greater detail hereinafter and in illustrated in the drawings in which:

FIG. 1*a* shows the warp thread spacings after treatment on a chain-type mercerising machine in accordance with the state of the art, FIG. 1*b* shows the warp thread spacings after treatment on a chain-less mercerising machine in accordance with the state of the art, FIG. 1*c* shows the warp thread spacings after treatment on an apparatus according to the invention, FIG. 2 is a greatly simplified view in cross-section through an apparatus according to the invention, FIG. 3 is a plan view of the apparatus shown in FIG. 2, FIG. 4 is a view in cross-section taken along line A—A in FIG. 2, FIG. 5 is a view in cross-section through an alternative embodiment with a plurality of spray pipes, FIG. 6 is a diagrammatic view of the quantitative distribution of the lye applied to the fabric web, and FIG. 7 is a plan view of the embodiment shown in FIG. 5.

FIGS. 1*a* and 1*b* show the disadvantages already mentioned above in a width-wise stretching process in accordance with the state of the art. In FIG. 1*a* the warp threads 1 in the two edge zones 14 and 14' are at a greater spacing b than the spacing a in the central zone 19. That phenomenon occurs in known chain-type tentering machines without controlled stabilisation of the fabric web. The width-wise stretching forces act almost exclusively on the two edge zones while the central zone 19 remains unchanged.

In a width-wise stretching operation using especially designed stabilisation or width-wise stretching rollers, the effect which occurs is the opposite one but equally undesirable, as shown in FIG. 1*b*. The width-wise stretching effect decreases from the centre towards the outside so that the distance a between the warp threads in the edge zones is less than the spacing b in the central zone 19. It is obvious that a mercerised fabric web with a structure as shown in one of FIGS. 1*a* and 1*b* does not fufil the desired quality requirement.

FIG. 1*c* shows the configuration of the fabric web, which is desired in itself and which is also achieved with the process according to the invention, and in which the warp threads 1 are at a uniform spacing c both in the central zone 19 and also in the edge zones 14 and 14'. That uniform spacing is produced by locally differentiated control of the stabilisation procedure so that the width-wise stretching forces can extend from the outside uniformly over the entire width of the fabric web.

As shown in FIGS. 2 and 3 a mercerising machine 3 comprises various treatment sections through which the endless fabric web continuously passes. In that arrangement the fabric web 2 is introduced in an entry zone 4 into the impregnation zone 5 where impregnation is effected in a hot lye bath with the web guided in a bound condition. The impregnation zone is followed by a cooling zone 6 and a residence zone 7. As can be seen from FIG. 3, the width of the fabric web 2 continuously decreases due to shrinkage in the last two zones. Therefore the fabric web must be stretched again in the width-wise stretching zone 8, in as careful a fashion as possible. The zone 8 is then followed by the stabilisation and lye-removal zone 9 where the mercerising process is concluded. The fabric web 2 which is treated in that way is then passed to a post-treatment machine 10. Details about such a mercerising process can be found for example in above-mentioned EP-A-No. 198 793.

Arranged in the width-wise stretching zone 8 is a tentering frame 11 which is provided with a pair of tentering chains 12. The tentering chains 12 engage the edges of the web by force-locking engagement in per se known manner by means of needle bars and/or clamps and stretch the fabric web in the conical entry area of the tentering frame where the distance between the two tentering chains increases. The fabric web is then held by the tentering chains in a parallel-sided portion, over a given distance. It was already known for hot weak lye to be sprayed onto the fabric web from spray nozzles above the tentering frame 11 and in particular also above the conical entry area. That provides that the shrinkage forces are carefully reduced and provides for stabilisation of the stretched fabric web.

In accordance with the invention the spraying operation using hot weak lye or another hot medium is now effected in such a way that the edge zones 14 and 14' are sprayed more intensively than the central zone 19, in the conical entry area. That is achieved by virtue of the spray pipes 13 and 13' which are arranged above the edge zones approximately at the same angle as the entry area. Arranged on the spray pipes are spray nozzles (not shown), for example in the form of simple bores which produce a spray density that decreases from the outside inwardly, as shown in FIG. 4. So that the spray pipes 13 and 13' also adapt to different widths of fabric web, the spray pipes are arranged on the tentering frame 11 in such a way that they can be adjusted in respect of width together with the tentering chains 12. FIG. 4 symbolically represents an adjusting device 18 on which the spray pipes 13 and the tentering chains 12 can be adjusted for example by way of a spindle, by means of a motor M. The spindle has opposite screwthread portions so that the nuts carried thereon move towards or away from each other when the spindle is rotated. Both spray pipes are fed by way of a common manifold line 17. When using adjustable spray pipes, they are connected to the line 17 for example by way of a flexible hose.

Arranged in the parallel-sided area of the tentering frame are transversely disposed spray pipes 15 by way of which the fabric web is uniformly sprayed with lye, after the conclusion of the stretching process.

In the alternative embodiment shown in FIGS. 5 and 7, a plurality of parallel spray pipes 13 are fixedly arranged above each of the two edge zones 14 and 14'. The spray pipes 13 are also fed by way of a common manifold line 17. However, a valve 16 is arranged between the line 17 and each individual spray pipe so that individual spray pipes can be cut in or out, depending on the width of the fabric web to be treated in that way. The amount of medium which is to be sprayed by way of each individual spray pipe can also be controlled by way of the valves 16. This embodiment has the advantage that the spray pipes do not have to be laterally displaceably mounted.

It will be seen that the spray nozzles could also be arranged in a different fashion, to produce the desired effect. Thus for example transversely disposed spray pipes could also be fixed above the conical entry area of the tentering frame, similarly to the spray pipes 15 above the parallel-sided portion. More intensive spraying of the edge zones could also be achieved by means of bores on those pipes, the frequency of which decreases from the outside inwardly.

An example of the quantitative distribution of the sprayed weak lye is shown in FIG. 6. In FIG. 6, the amount of lye is plotted against the ordinates O and the width of the fabric web is plotted against the abscissae A. The edge zones R amount to about 30% of the total width of the fabric web. In the outermost regions, about three times as much weak lye is applied as in the central zone M. The total amount, that is to say the average of the amount of lye in the edge zone R, is about twice the amount of lye applied in the central zone M.

It will be seen that the configuration of the curve may be varied depending on the nature, arrangement and/or control of the spray nozzles.

I claim:

1. In a process for mercerising a fabric web (2) in which the fabric web is stretched in respect of width after an impregnation operation by means of a pair of tentering chains (12) in a tentering frame (11) with a generally conical entry area, wherein the fabric web (2) is sprayed with a hot medium from spray nozzles arranged above the tentering frame, for stabilisation purposes, the improvement wherein at least in the conical entry area of the tentering frame (11) the edge zones (14, 14') of the fabric web (2) are sprayed more heavily than the central zone (19) thereof.

2. A process according to claim 1 characterised in that the spray density decreases substantially uniformly from the edge zones (14, 14') of the fabric web (2) towards the central zone (19) thereof.

3. A process according to claim 1 characterised in that the edge zones (14, 14') respectively make up at least 10% of the width of the article and at most 40% of the width of the article.

4. A process according to claim 1 characterised in that at least double the amount of hot medium is sprayed onto the edge zones (14, 14').

5. In apparatus for mercerising a fabric web (2) comprising a tentering frame (11) having a pair of tentering chains (12) and a conical entry area for stretching the fabric web (2) in respect of width after an impregnation operation, and spray nozzles arranged above the tentering frame (11) for spraying the fabric web with a hot medium, the improvement wherein at least in the conical entry area of the tentering frame (11) the spray nozzles are arranged predominantly over the two edge zones (14, 14') of the fabric web (2) so as to spray the edge zones more heavily than the central zone of the fabric, the edge zones (14, 14') respectively making up at least 10% and at most 40% of the set fabric web width.

6. Apparatus according to claim 5 characterised in that the spray nozzles are arranged on at least one respective spray pipe (13) which is arranged approximately at the same angle as the tentering chain (12) on both sides of the fabric web (2) in the conical entry area above the edge zone (14).

7. Apparatus according to claim 6 characterised in that the spray nozzles are such in regard to arrangement and/or opening cross-section that the amount of sprayed medium decreases towards the central zone (19) of the fabric web (2).

8. Apparatus according to claim 6 characterised in that the tentering frame (11) has a per se known adjusting device (18) for varying the distance between the two tentering chains (12) and that the spray pipes (13) are so arranged on the tentering frame that they are adjustable together with the tentering chains.

9. Apparatus according to claim 6 characterised in that arranged above each edge zone (14) are a plurality of parallel spray pipes (13) which can be actuated individually by way of control valves (16).

10. Apparatus according to claim 5 characterised in that spray pipes (15) are arranged above the parallel-sided area of the tentering frame, the spray pipes extending transversely with respect to the fabric web (2) and being provided with spray nozzles which are uniformly distributed over the entire width of the fabric web.

11. A process for mercerising a fabric web in which the fabric web is stretched in respect of width after an impregnation operation by means of a pair of tentering chains in a tentering frame with a conical entry area wherein the fabric web is sprayed with a hot medium from spray nozzles arranged above the tentering frame, for stabilization purposes, the improvement wherein at least in the conical entry area of the tentering frame the edge zones of the fabric web are sprayed more heavily than the central zone thereof, whereby at least double the amount of hot medium is sprayed onto the edge zones, and said edge zones respectively make up at least 10% of the width of the article and at most 40% of the width of the article.

* * * * *